US008272136B2

(12) United States Patent
Vogeler et al.

(10) Patent No.: US 8,272,136 B2
(45) Date of Patent: Sep. 25, 2012

(54) WALLBOARD CUTTING TOOL

(76) Inventors: Craig A. Vogeler, North Loup, NE (US); David M. Lech, Ord, NE (US); John W. Weiner, North Loup, NE (US)

( * ) Notice: Subject to any disclaimer, the term of this patent is extended or adjusted under 35 U.S.C. 154(b) by 506 days.

(21) Appl. No.: 12/655,741

(22) Filed: Jan. 6, 2010

(65) Prior Publication Data

US 2011/0162220 A1 Jul. 7, 2011

(51) Int. Cl.
*B43L 13/00* (2006.01)

(52) U.S. Cl. ..... 33/32.1; 33/42; 30/286

(58) Field of Classification Search ..... 33/27.03, 33/32.1, 32.2, 32.3, 33, 41.1, 42; 30/280, 30/286

See application file for complete search history.

(56) References Cited

U.S. PATENT DOCUMENTS

| | | | | |
|---|---|---|---|---|
| 2,975,520 | A * | 3/1961 | Erickson et al. | 33/41.1 |
| 3,127,680 | A * | 4/1964 | Brichard et al. | 33/32.3 |
| 5,406,711 | A * | 4/1995 | Graham | 33/42 |
| 8,020,312 | B1 * | 9/2011 | McGahan | 33/42 |
| 2003/0019116 | A1 * | 1/2003 | DeWall | 33/42 |
| 2007/0163130 | A1 * | 7/2007 | Kyoung-Soo | 33/42 |
| 2008/0141549 | A1 * | 6/2008 | Brown | 33/755 |
| 2012/0073152 | A1 * | 3/2012 | McGahan | 33/32.3 |

* cited by examiner

*Primary Examiner* — G. Bradley Bennett
(74) *Attorney, Agent, or Firm* — Dennis L. Thomte; Thomte Patent Law Office LLC

(57) ABSTRACT

A cutting tool is provided which may simultaneously score or cut opposite sides of a wallboard. The tool may also be used to cut semi-circular portions from a corner of the wallboard and which may be used to cut circles from the wallboard.

7 Claims, 6 Drawing Sheets

WALLBOARD CUTTING TOOL

BACKGROUND OF THE INVENTION

1. Field of the Invention

This invention relates to a wallboard cutting tool and more particularly to a cutting tool which may be used to simultaneously score or cut opposite sides of the wallboard being cut. Even more particularly, the cutting tool of this invention may also be used to cut semi-circular portions from a wallboard. Even more particularly, the cutting tool of this invention may be partially dissembled with a portion thereof being used to score or cut a circular portion on one side of the wallboard and then being usable to score or cut the opposite side of the wallboard so that a circular cut-out portion may be created in the wallboard.

2. Description of the Related Art

Wallboards or sheetrock are generally rectangular and usually are four feet wide and seven or eight feet long. In the past, when it was found necessary to cut some portion of one side edge or some portion of an end edge from the wallboard to make it fit, a straightedge was normally placed on one side of the wallboard with a cutting knife then being moved along one edge of the straightedge to score or cut through the paper at one side of the wallboard. Upon being scored, the carpenter or drywall installer would attempt to break that portion of the wallboard being cut away and then reached through the cut portion with a cutting knife and attempt to cut the paper at the back side of the wallboard. In some cases, the carpenter would turn the wallboard over and then cut through the paper on the opposite side of the wallboard along the crease therein formed by partially breaking the cut portion from the remainder of the wallboard. The prior art methods just described frequently resulted in irregular cut edges which then would have to be sanded to provide a smooth edge.

Further, to the best of Applicants' knowledge, there has not been a cutting tool which may be used to precisely cut circles or semi-circles from wallboard.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A wallboard cutting tool is described which includes a horizontally disposed and elongated support beam means having first and second ends with the support beam means including a base end portion having upper and lower ends, a first elongated upper beam member, having first and second ends, extending horizontally from the base end portion, and a second elongated lower beam member, having first and second ends, which extends horizontally from the base end portion. The upper and lower beam members have their first ends joined to the base end portion of the beam means so as to be vertically spaced-apart and disposed parallel to one another.

A first cutting blade is vertically adjustably secured to the second end of the first beam member and which extends downwardly therefrom. A second cutting blade is vertically adjustably secured to the second end of the second beam member and which extends upwardly therefrom in the same vertical plane as the first cutting blade. In the preferred embodiment, the upper beam member has measurement indicia provided thereon.

The cutting tool also includes an elongated and horizontally disposed wallboard engagement member or slide having an upper end, a lower end, a first side, a second side, a first end and a second end. The wallboard engagement member is selectively movably mounted on the beam members in a transversely disposed manner with respect to the longitudinal axes of the beam members and with the second side thereof facing the second ends of the beam members. The second side of the wall board engagement member has an elongated wallboard receiving channel formed therein which extends thereinto and which is adapted to receive an edge of a wallboard so that the first and second cutting blades will be in cutting engagement with the opposite sides of the wallboard.

In the preferred embodiment the inner side wall of the wallboard receiving channel has a V-shaped notch formed therein which is adapted to receive one corner of the wallboard so that a semi-circular portion may be cut from the corner of the wallboard.

In the preferred embodiment, the upper beam member may be selectively removably detached from the base end portion and from the wallboard engagement member so that it may be used to cut circles from the wallboard.

It is therefore a principal object of the invention to provide an improved wallboard cutting tool.

A further object of the invention is to provide a wallboard cutting tool which may be used to simultaneously score or cut opposite sides of the wallboard along one edge thereof.

A further object of the invention is to provide a wallboard cutting tool which may be used to cut semi-circular portions from a corner of a wallboard.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
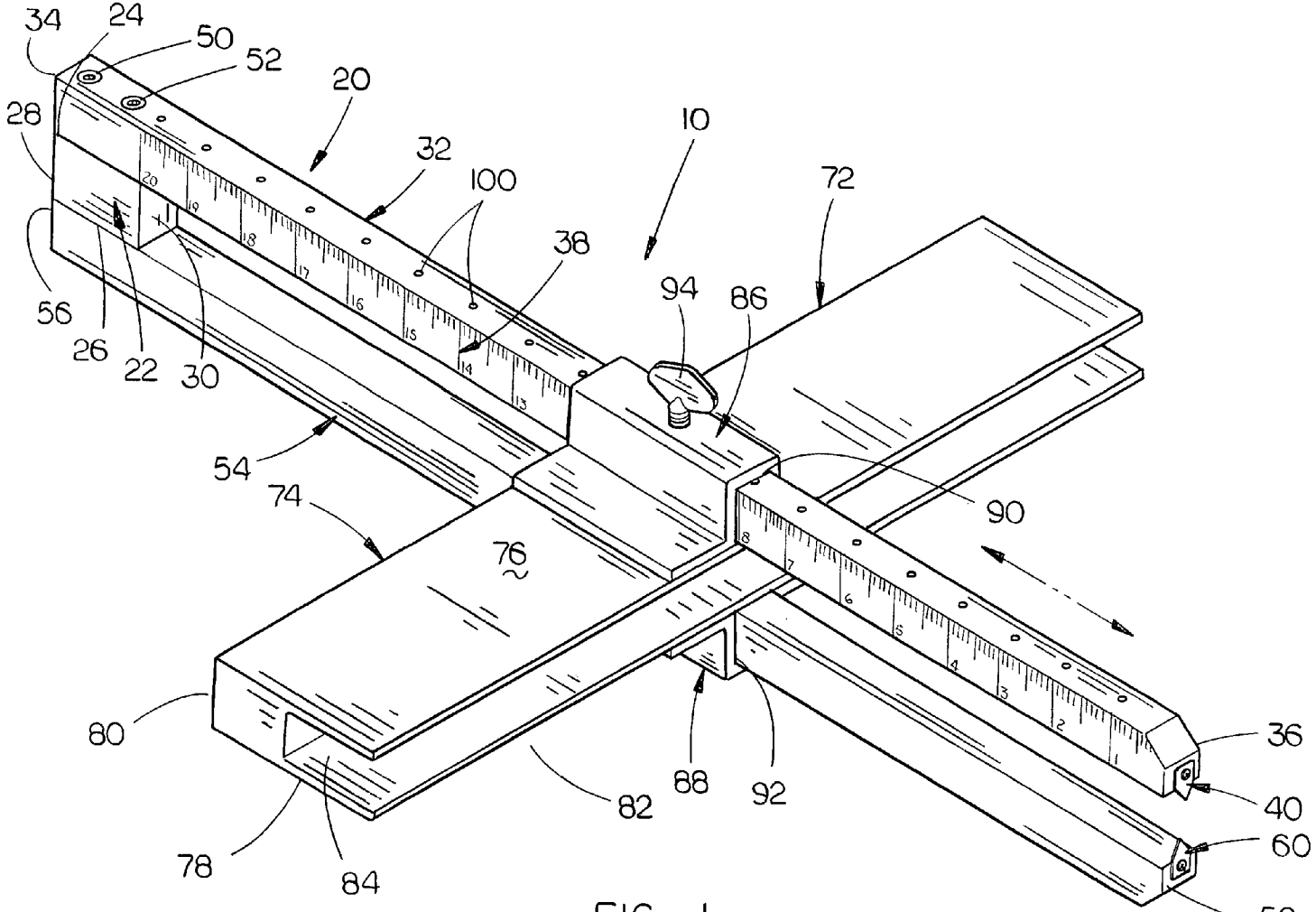
FIG. 1 is a perspective view of the cutting tool of this invention.
Figure 2:
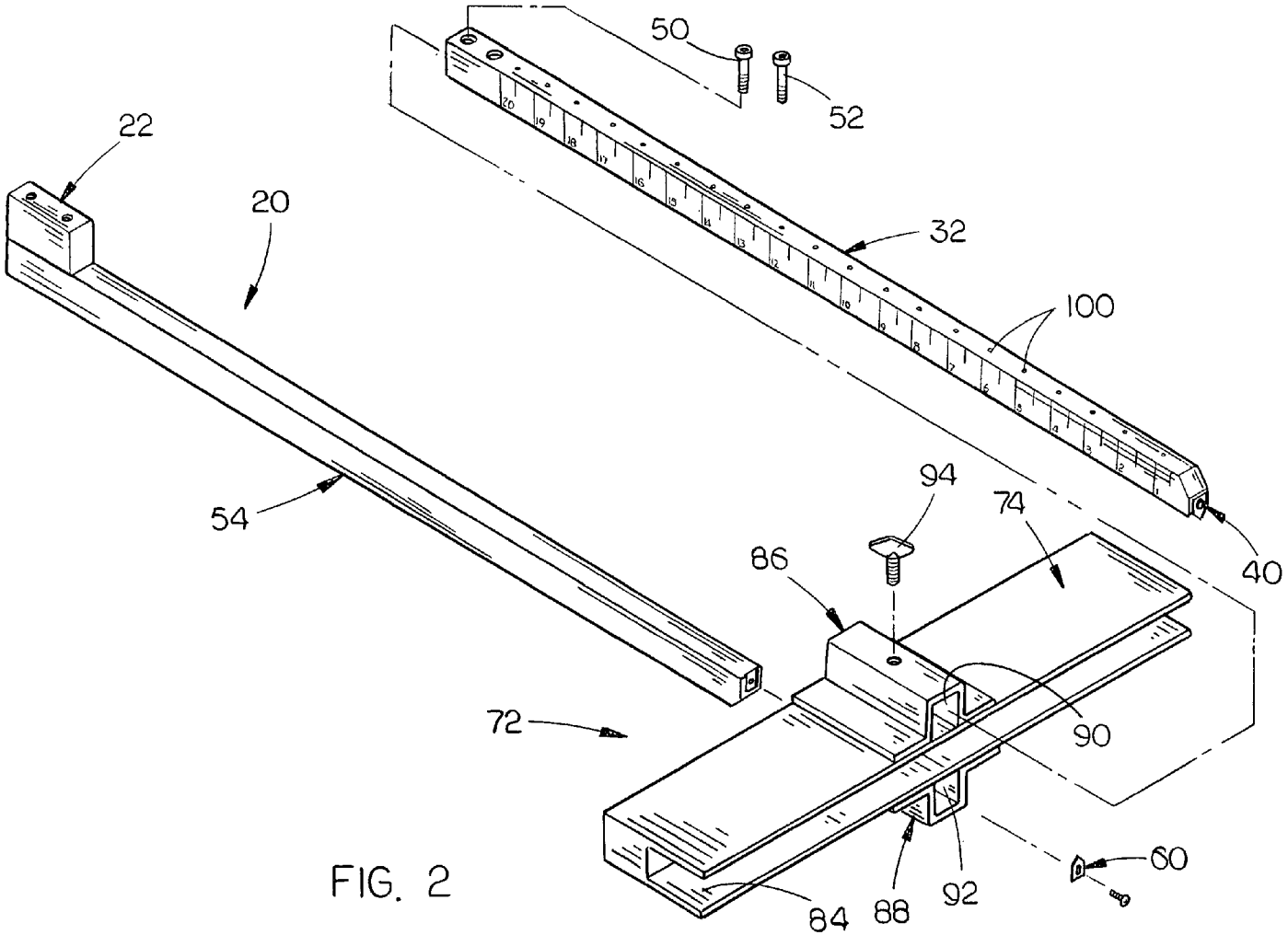
FIG. 2 is an exploded perspective view of the cutting tool of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

For purposes of description only and not to be construed as limiting the invention whatsoever, the summary, specification and claims describe the wallboard cutting tool of this invention as if the tool were horizontally disposed although the tool may be used in almost any orientation.

The wallboard cutting tool of this invention is referred to generally by the reference numeral 10 and which may be used to cut portions from a conventional wallboard 12 which have opposite surfaces 14 and 16 with plaster or the like positioned between paper layers. Tool 10 includes a support beam means 20 having a base end portion or block 22 having an upper end 24, lower end 26 and opposite ends 28 and 30. Support beam means 20 also includes an elongated upper beam member 32 which preferably has a rectangular or square cross-section and which includes a first end 34 and a second end 36. Preferably, one side of the beam member 32 has measurement indicia 38 formed therein.

Figure 3:
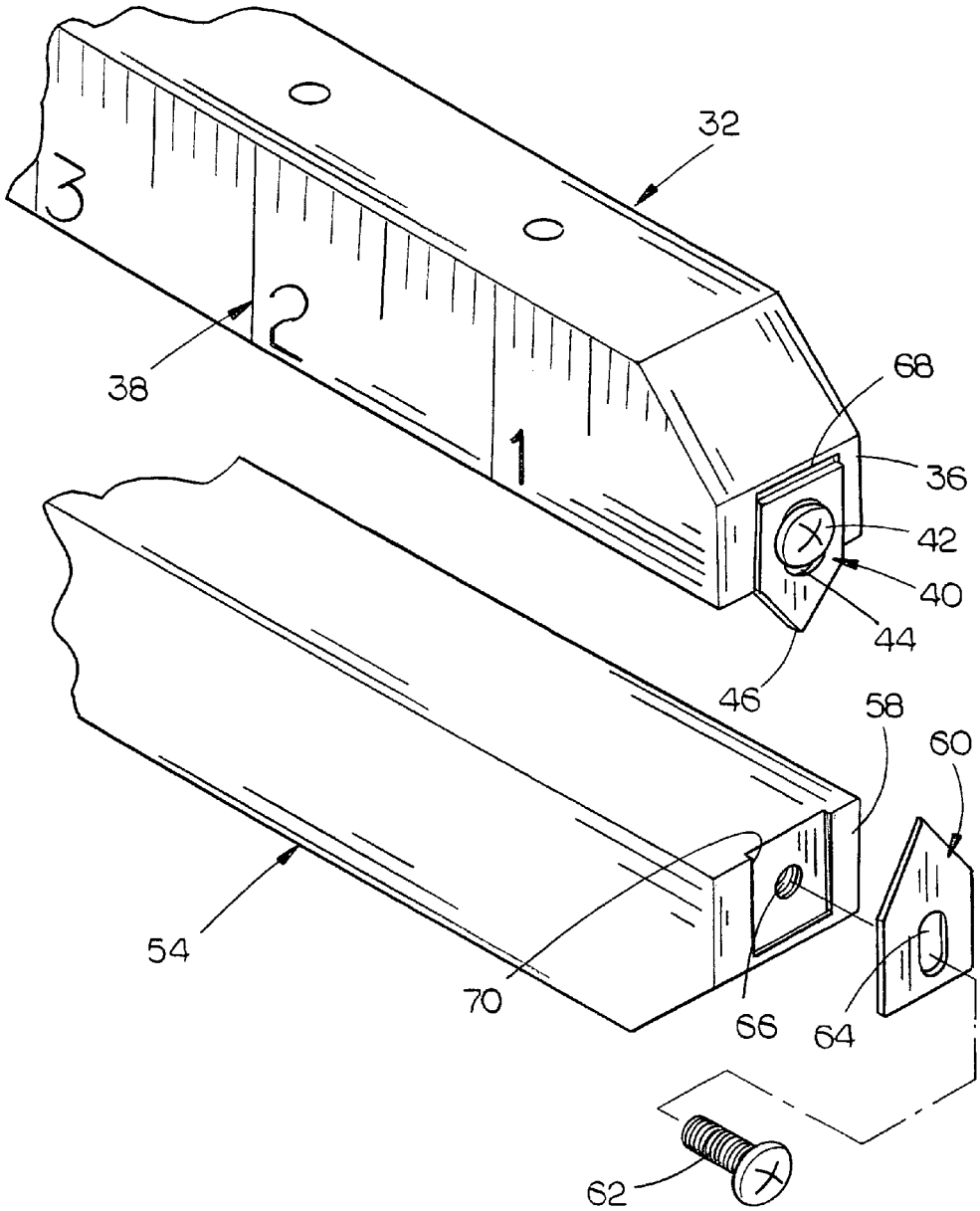
FIG. 3 is a partial perspective view illustrating the manner in which the cutting blades or cutting members are secured to the ends of the beam members of the cutting tool.

End 36 of beam number 32 has a cutting member or blade 40 vertically adjustably secured thereto by means of screw 42 extending through a vertically disposed slot 44 formed in blade 40 and into a threaded opening formed in the end of beam member 32 (FIG. 3). Preferably, blade 40 has a sharp point 46 at the lower end thereof. The first end 34 of beam member 32 is secured to the base end portion 22 by means of a pair of screws 50 and 52.

Support beam 20 also includes a lower elongated beam member 54 having a first end 56 and a second end 58. The first end 56 of beam member 54 is secured to the lower end of base end portion 22 by the screws 50 and 52 extending therethrough and which normally would have nuts at the lower end thereof. Beam member 54 extends from base end portion 22 directly below beam member 32 and in a parallel spaced-apart relationship as seen in FIG. 1. The numeral 60 refers to a cutting blade or member which is vertically adjustably secured to end 58 of beam member 54 by means of screw 62 extending through slot 64 of blade 60 into the interior threaded opening 66 in end 58 of beam member 54 (FIG. 3). Preferably, both the blades 40 and 60 are received by recessed areas 68 and 70 formed in the ends 36 and 58 of beam members 32 and 54 respectively to prevent the blades 40 and 60 from pivotally moving with respect to their respective screws.

The numeral 72 refers to a wallboard engagement member or slide which is selectively longitudinally slidably movable on the beam members 32 and 54. Slide 72 is disposed transversely with respect to the beam members 32 and 54 as seen in FIG. 1, and will be described as having a rectangular-shaped body portion 74 having an upper surface 76, lower surface 78, end 80 and end 82 with end 82 facing the ends 36 and 58 of beam members 32 and 54 respectively. The numeral 84 refers to a channel or groove which extends into the end 82 of body portion 74 to provide a wallboard edge receiving area as will be described in more detail hereinafter. Slide 72 includes an upper mounting structure 86 and a lower mounting structure 88 having channels 90 and 92 formed therein respectively which are adapted to slidably receive the beam members 32 and 54 respectively. A thumb screw 94 is threadably mounted on the mounting structure 86 for engagement with the upper beam member 32 to maintain the slide 72 in its desired position. Preferably, the back wall 96 of channel 84 has a V-shaped notch 98 formed therein which is adapted to receive one corner of the wallboard 12 when it is desired to cut a semi-circular portion from the corner of the wallboard 12, as seen in FIG. 5.

Preferably, beam member 32 has a plurality of vertically disposed and horizontally spaced-apart bores or openings 100 extending therethrough for a purpose to be described hereinafter.

Figure 4:
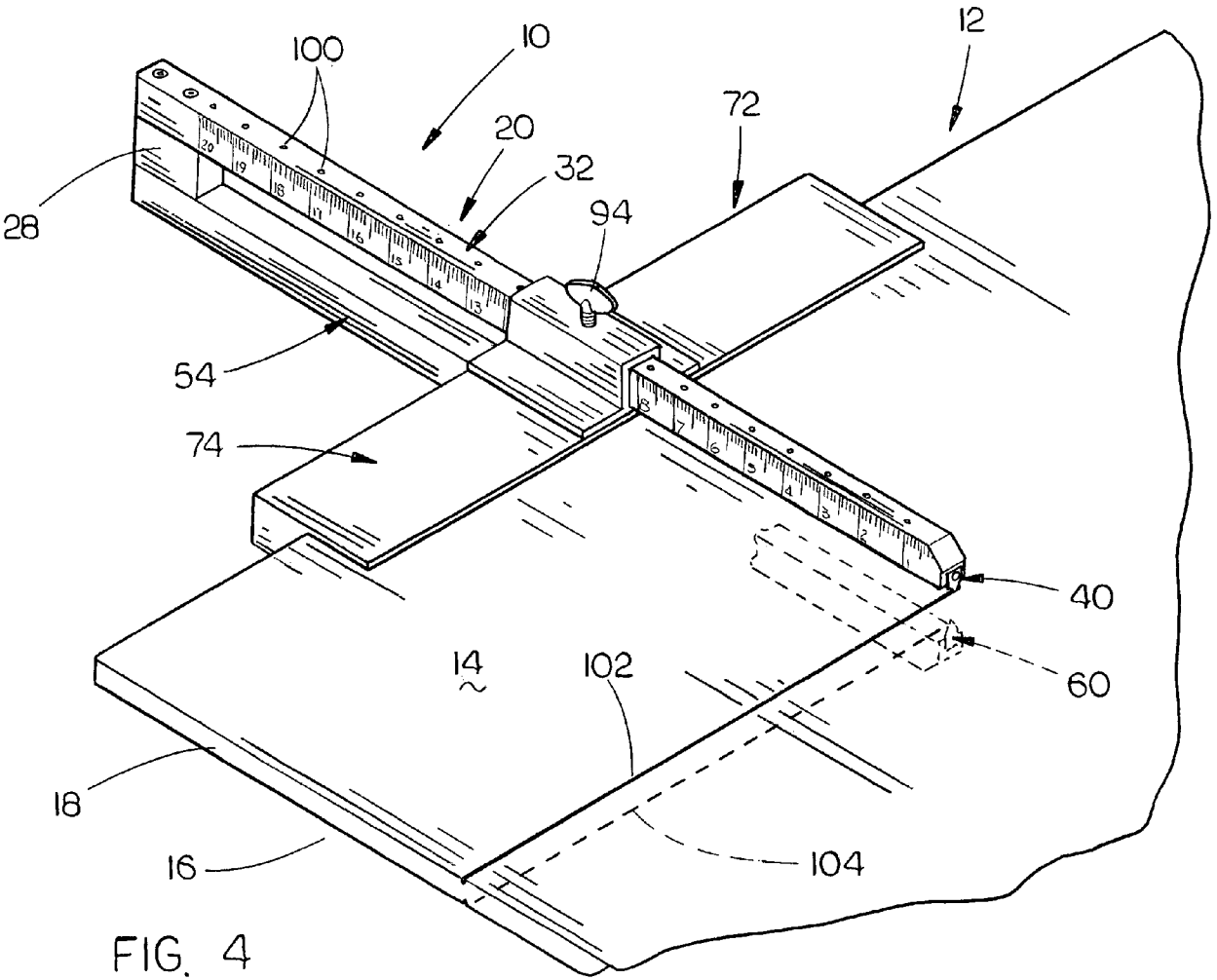
FIG. 4 is a perspective view illustrating the manner in which the cutting tool of this invention may be used to simultaneously score or cut opposite sides of a wallboard.

When it is desired to cut a portion of the wallboard 12 from either the upper edge, lower edge, or opposite side edges, the wallboard 12 will normally be positioned on one or more saw horses or will be positioned on the ground in a vertically disposed position with the edge to be trimmed being horizontally disposed. Assuming that the wallboard 12 is placed on a pair of saw horses so that the wallboard 12 in a horizontally disposed position, the slide 74 will be adjusted using the indicia 38 to the proper position with the thumb screw 94 then being tightened. The tool 10 will then be slipped over the edge of the wallboard 12 so that the edge of the wallboard 12 will be inserted into one end of the channel 84. The tool 10 will then be moved with respect to the wallboard 12 so that the blades 40 and 60 will simultaneously cut or score the paper and a portion of the plaster therebetween in the manner illustrated in FIG. 4. When the slide 72 has been moved from one end to another of the wallboard 12 or from one side edge of the wallboard to the other edge thereof, score lines 102 and 104 will be formed in opposite sides of the wallboard. When the cutting operation has been achieved, that portion of the wallboard which has been cut from the remainder of the wallboard may be broken off in a very smooth manner. The vertical adjustment of the blades 40 and 60 permits the tool to be used with wallboards having different thicknesses.

Figure 5:
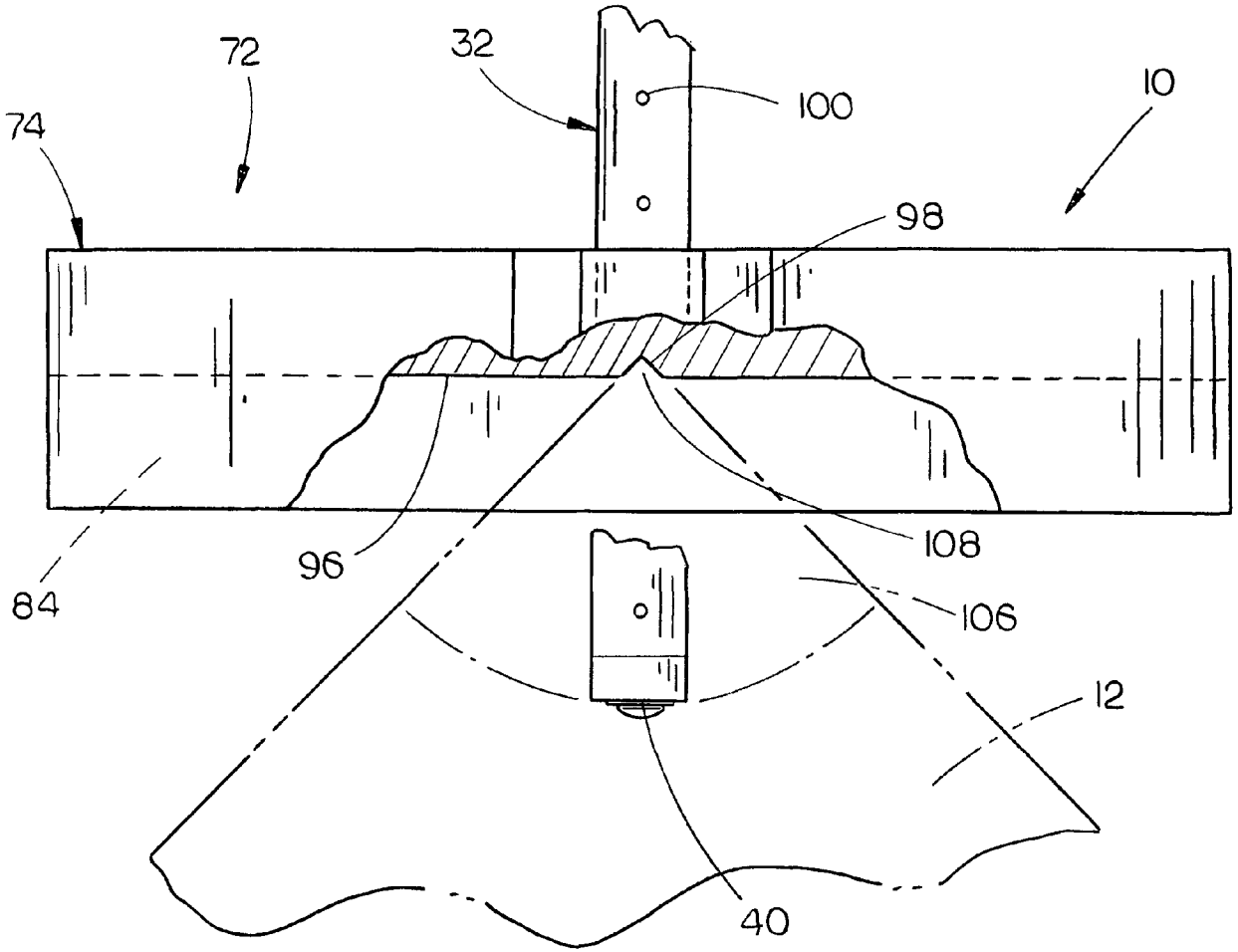
FIG. 5 is a partial sectional view illustrating the manner in which the cutting tool of this invention may be used to cut a semi-circular portion from a corner edge of a wallboard.
Figure 6:
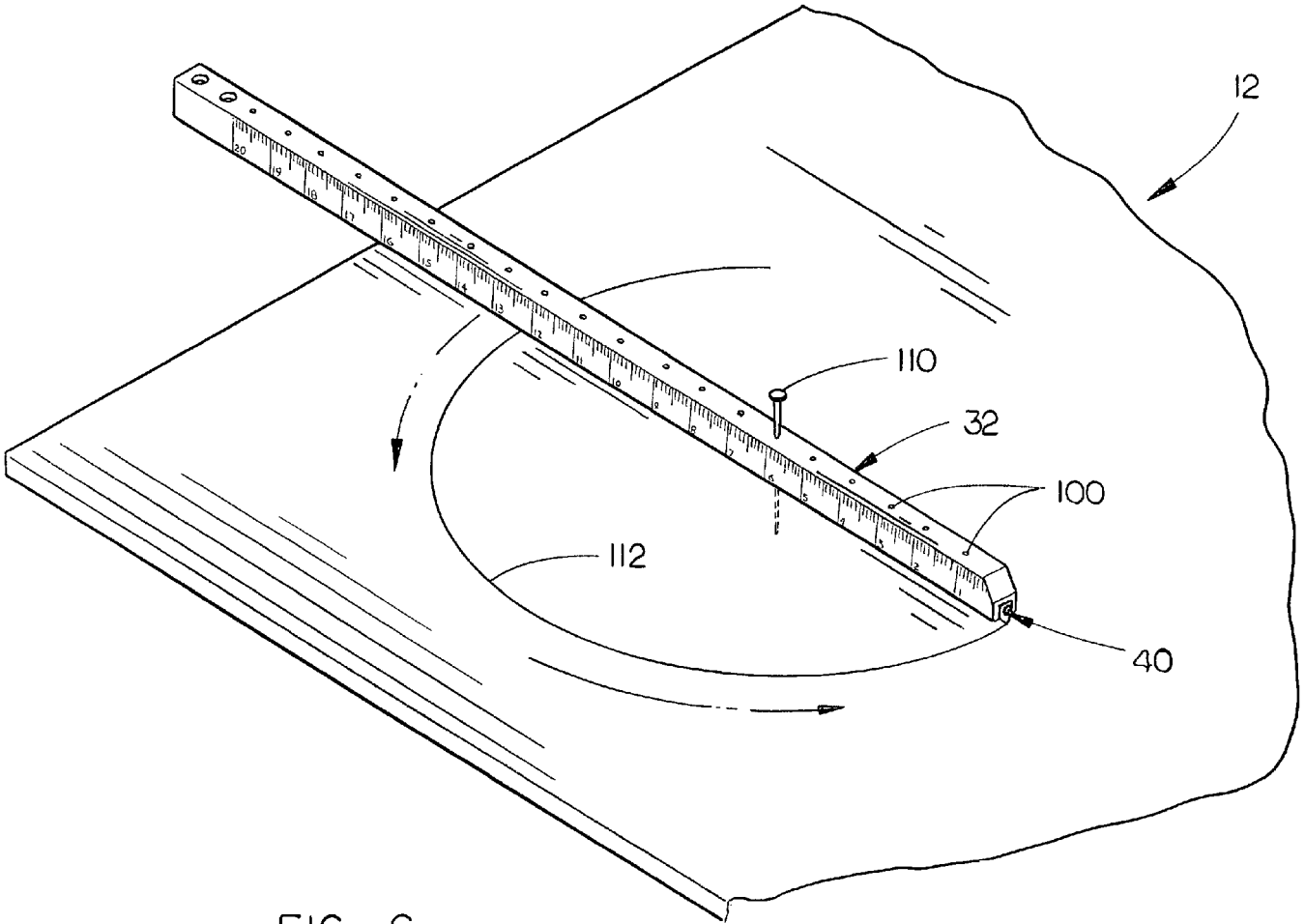
FIG. 6 is a perspective view illustrating the manner in which the upper beam member may be used to cut a circular portion from the wallboard.

If it is desired to cut a semi-circular portion 106 from the wallboard 12 as illustrated in FIG. 5, a corner 108 of the wallboard 12 will be inserted into the channel 84 and received by the V-shaped notch 48. The tool 10 may then be pivotally moved with respect to the wallboard so that score lines are created in the upper and lower surfaces of the wallboard 12 in a simultaneous manner. When the upper and lower surfaces of the wallboard 12 have been scored, the tool 10 is removed from the wallboard 12 and the section 106 of the wallboard 12 is broken from the remainder of the wallboard.

If it is desired to cut a circular hole or opening in the wallboard, the upper beam member 32 is removed from the support beam means 20 by removing the screws 50 and 52. The beam member 32 is then removed from the slide 72. When the center of the circle to be removed from the wallboard 12 has been determined, the upper beam 32 is placed on the upper surface of the wallboard 12 with the proper bore 100 registering with that center of the circle. The nail or pin 110 is then pushed downwardly through the proper opening 100 and extended completely through the wallboard 12 so that a hole or opening is also formed in the other side of the wallboard 12. The nail or pin 110 acts as a pivot pin so that the beam member 32 may be pivotally moved around the pin 110 so that the blade 40 will score a circular line 112 in the upper surface of the wallboard 12. When that score line 112 has been completed the pin or nail 110 is removed from the wallboard and with the beam member 32 being also removed from the wallboard. The wallboard 12 is then turned over and there will be an opening formed therein by the previous insertion of the nail 110 which will indicate the exact center of the circle to be cut out from the wallboard 12. The nail 110 is then inserted through the opening previously formed in the wallboard 10 so that the blade 40 will be disposed directly above the previously created score line in the other side of the wallboard 12. The beam member 32 is then pivotally moved with respect to the pin 110 to create a circular score line directly above the previously created score line 112. When the score line has been completed, the beam 32 is removed from the wallboard and the circular portion is knocked or punched from the wallboard 12.

Thus it can be seen that a novel cutting tool has been provided which permits opposite sides of a wallboard to be simultaneously scored. It can also be seen that a tool has been provided which enables semi-circular portions of a corner of a wallboard to be removed therefrom. It can also be seen that a cutting tool has been provided wherein a portion thereof may be removed therefrom to cut circles from the wallboard.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A wallboard cutting tool, comprising:

a horizontally disposed and elongated support beam means having first and second ends;

said support beam means comprising a base end portion, a first elongated upper beam member, having first and second ends, extending horizontally from said base end portion, and a second elongated lower beam member, having first and second ends, extending horizontally from said base end portion;

said upper and lower beam members having their said first ends joined to said base end portion so as to be vertically spaced-apart and disposed parallel to one another;

a first cutting member at said second end of said first beam member which extends downwardly therefrom;

a second cutting member at said second end of said second beam member which extends upwardly therefrom in the same plane as said first cutting member;

at least one of said beam members having measurement indicia thereon;

an elongated horizontally disposed wallboard engagement member having an upper end, a lower end, a first side, a second side, a first end and a second end;

said wallboard engagement member being selectively movably mounted on said beam members in a transversely disposed manner with respect to the longitudinal axes of said beam members with said second side thereof facing said second ends of said beam members;

said second side of said wallboard engagement member having an elongated wallboard receiving channel formed therein which is adapted to receive an edge of a wallboard so that side first and second cutting members will be in cutting engagement with opposite sides of a wallboard.

2. The wallboard cutting tool of claim 1 wherein each of said beam members has a quadrilateral cross-section and wherein said wallboard engagement member has a pair of vertically spaced-apart channel members formed therein which slidably receive said first and second beam members respectively.

3. The wallboard cutting tool of claim 1 wherein said wallboard receiving channel has an inner wall and wherein a V-shaped notch is formed therein between said beam members so that said notch may receive a corner of a wallboard.

4. The wallboard cutting tool of claim 1 wherein said first ends of said beam members are selectively removably secured to said base end portion.

5. The wallboard cutting tool of claim 1 wherein said first end of said first beam member is selectively removably secured to said base end portion and said first beam member is selectively removably secured to said wallboard engaging member so that said first beam member may be used individually to cut a circle in a wallboard.

6. The wallboard cutting tool of claim 5 wherein said first beam member has a plurality of spaced-apart and vertically disposed openings extending therethrough which are adapted to receive a nail means therein which may pierce through the wallboard to position said first beam member with respect to the wallboard and to provide a mark at the opposite side of the wallboard which may be used when the opposite side of the wallboard is to be cut.

7. The wallboard cutting tool of claim 1 wherein said cutting members are selectively vertically adjustably secured to said first and second beam members to accommodate wallboards of different thicknesses.

* * * * *